United States Patent [19]

Ponzio

[11] Patent Number: 5,010,334

[45] Date of Patent: Apr. 23, 1991

[54] TRANSDUCER DEVICE

[75] Inventor: Vittorio Ponzio, Milan, Italy

[73] Assignee: Fabbriche Riunite Misuratori Sacofgas S.p.A., Milan, Italy

[21] Appl. No.: 297,434

[22] Filed: Jan. 17, 1989

[30] Foreign Application Priority Data

Jan. 18, 1988 [IT] Italy ..... 19101 A/88

[51] Int. Cl.[5] ..... G06M 1/22; G06M 1/27

[52] U.S. Cl. ..... 340/870.28; 340/870.02; 377/87; 235/1 C

[58] Field of Search ..... 340/870.28, 870.02, 340/870.04; 377/82, 86, 87, 30, 91, 17, 16, 112; 235/144 MZ, 133 A, 91 M, 1 C, 91 H, 91 R, 136; 341/2

[56] References Cited

U.S. PATENT DOCUMENTS

| | | | |
|---|---|---|---|
| 3,017,086 | 1/1962 | Harker et al. | 235/136 |
| 3,262,108 | 7/1966 | Schuman | 341/2 |
| 3,310,801 | 3/1967 | Hood, Jr. et al. | 341/2 |
| 3,846,789 | 11/1974 | Germer et al. | 340/870.02 |
| 4,031,386 | 6/1977 | Recker | 377/87 |
| 4,199,676 | 4/1980 | Heuer | 341/2 |
| 4,426,574 | 1/1984 | Smilgys | 235/1 C |
| 4,811,368 | 3/1989 | Lee | 340/870.02 |

FOREIGN PATENT DOCUMENTS

| | | | |
|---|---|---|---|
| 0205779 | 12/1986 | European Pat. Off. . | |
| 2159479 | 6/1973 | France . | |
| 2212081 | 7/1974 | France . | |
| 2362368 | 3/1978 | France . | |
| 858193 | 1/1961 | United Kingdom . | |
| 2072906 | 10/1981 | United Kingdom . | |
| 2187011 | 8/1987 | United Kingdom | 377/16 |
| 2188159 | 9/1987 | United Kingdom . | |

*Primary Examiner*—Donald J. Yusko
*Assistant Examiner*—Yuk H. Lau
*Attorney, Agent, or Firm*—Young & Thompson

[57] ABSTRACT

A measuring transducer comprises at least one pair of coded revolving metric indicators (2, 2', 2''), each consisting of a metric drum (11, 11', 11'', 11''') and at least one coded revolving element. The revolving coded metric indicators (2, 2', 2'') are rotatable about the same shaft (9) and the coded revolving elements are each positioned out of phase ahead at an appropriate angle with respect to the preceding revolving coded element. An electronic processing (18) prevents the sending of a signal to a display device when the signal read from the coded revolving elements has a value lower than that of any signal previously sent.

17 Claims, 4 Drawing Sheets

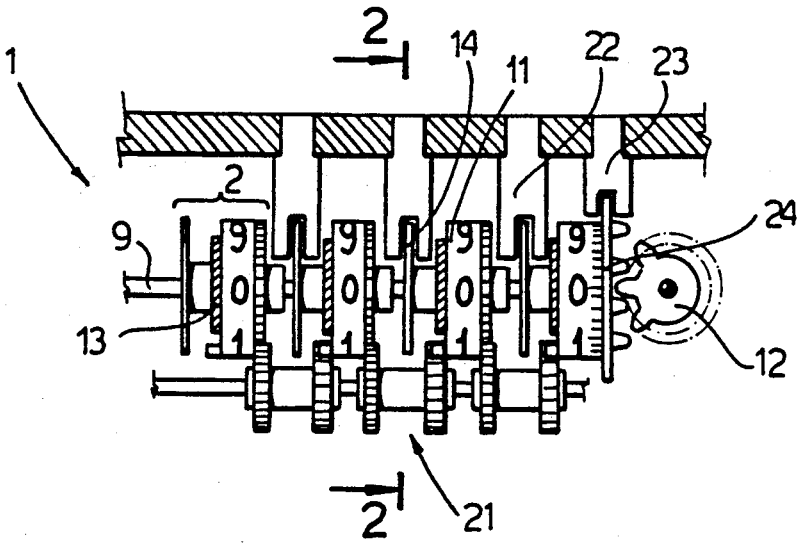
FIG. 1
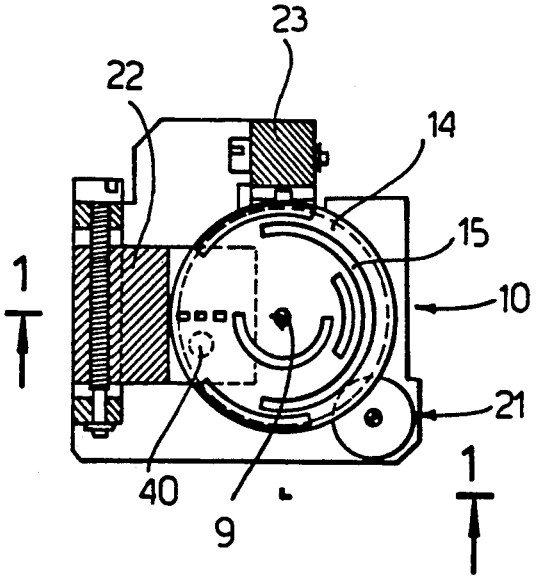
FIG. 2
FIG. 3
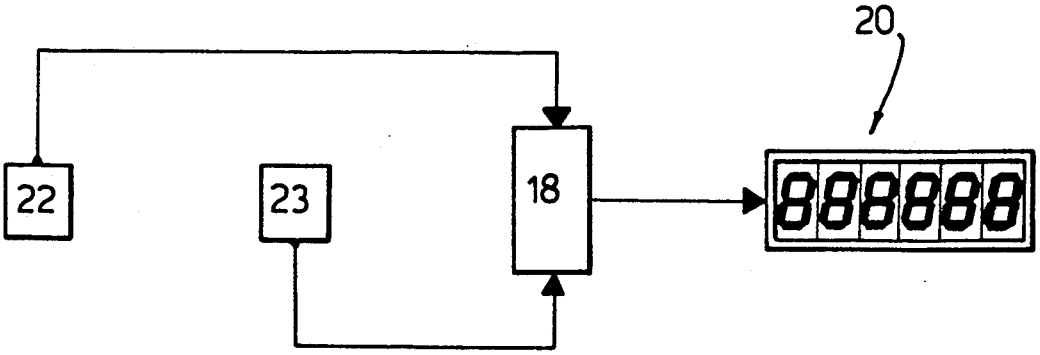

FIG. 10
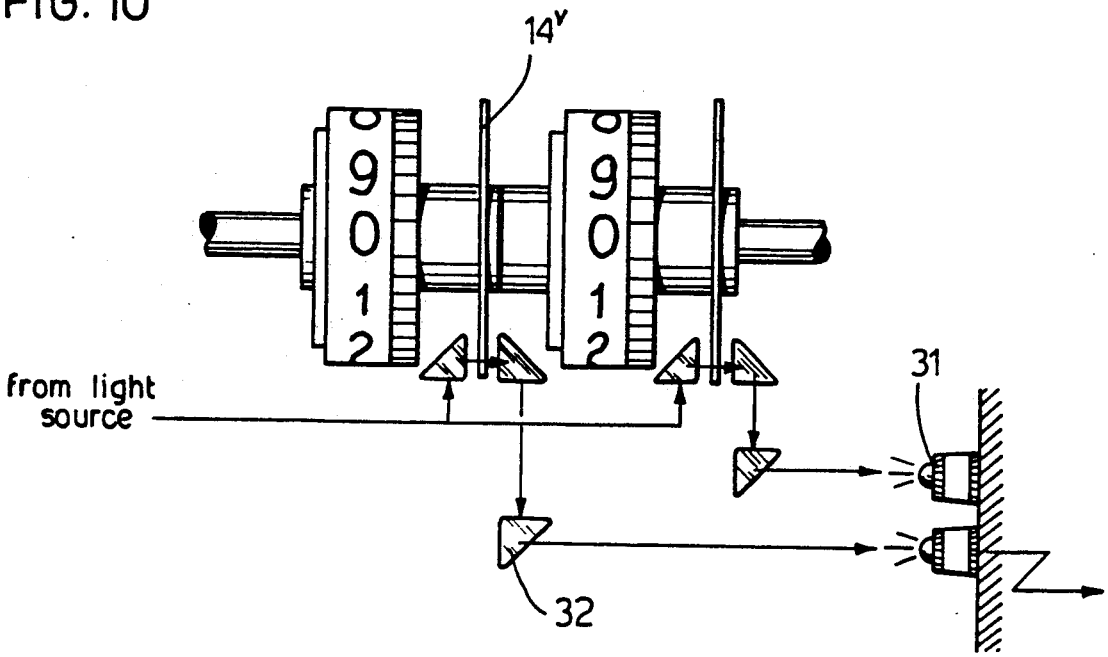
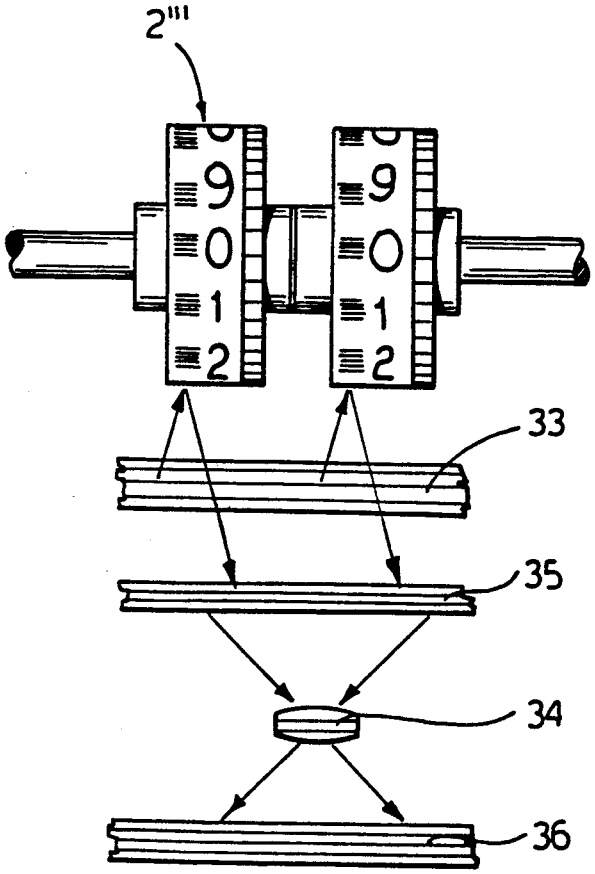
FIG. 11

TRANSDUCER DEVICE

The object of the present invention is a transducer measuring device based on the positioning of at least one pair of revolving mechanical elements. This device can be applied with advantage in the field of measuring angle dimensions, angular displacements, the number of revolutions and the indications of a mechanical meter for measuring fluids, gases or electricity.

A known type of meter, for example, is composed of an assembly of interacting revolving elements, controlled by a driving gear whose movement is related to the flow of fluid or gas passing in a given pipeline, in such a way as to obtain a correlation between the quantity of fluid or gas which has passed through and the number of revolutions or fractions of a revolution made by the revolving meter elements. Each revolving element is subdivided into a predetermined number of zones, each bearing a number. The revolving elements are coupled in such a way that as soon as one finishes a revolution it causes the one lying next to it to rotate at a predetermined angle. The indication of the number of revolutions or fraction of a revolution made by the assembly can be displayed and/or the mechanical measurement can be transduced into an electric signal which can be suitably handled.

A transducer device is known capable, for example, of allowing the number of revolutions shown by a meter of the above-mentioned type to be transduced, in which decade wheels are provided together with the metric drums, that is wheels comprising openings positioned according to a predetermined code, the indication of whose position is appropriately taken, the device being able also to comprise an element acting as a vernier, whose reading is taken and processed with the reading of said decade wheels so as to increase measurement precision.

The transducer devices of the type described above, produced up to the present day, foresee three wheel assemblies keyed to different axes. The first assembly is entirely mechanical and serves to provide rotary motion for the second assembly, which is composed of metric drums, on the first of which a sensor "vernier" can be mounted, said drums transmitting the motion to the third assembly, composed of elements coded according to a decadal code.

Transducer devices are also known which foresee wheel units keyed to the same shaft. In particular, in GB-A-2.072.906 a description is given of a device for indicating the distance covered by a vehicle, comprising a mechanical meter, composed of wheels each comprising a contact drum and a numbered disk. The contact drums are provided with protruding contact elements which are read by sliding contacts. Readings can also be effected by the eye from the numbered disk.

U.S. Pat. No. 3,723,711 describes another reading device comprising at least one numbered wheel, provided on its periphery with protruding elements, which are read by mobile contacts.

Both the patents mentioned have the drawback of foreseeing signals, for the remote transmission of reading data, detected by sensors, which are in direct contact with the meter element; this renders the device not only more cumbersome but also subject to errors originating from an inaccurate contact between the sensors and the meter.

On the other hand, in U.S. Pat. No. 3,281,819 a reading device is described comprising at least one numbered rotating drum, which bears a series of numbers or symbols on its periphery. The flat part of the drum is divided into as many sectors as the numbers or symbols contemplated; each sector bears notches, which are different for each sector. During the reading phase, the various sectors are lighted and the light passing through the notches is received by a photo-electric cell from which the number or symbol indicated derives.

Although this invention overcomes the drawbacks relating to the realizations described above, it has the defect of leading to errors in reading when the number of numbered rotating drums (and therefore the numbers to be read) is more than one. In this case, in fact, due to the unavoidable mechanical clearance existing between the drums, synchronized angular displacement is not obtained at the passage from the lower to the upper decade, in the case of the drums being numberd from 0 to 9, or, in any case, at the passage from the reading made up of a determined symbol "n" on the preceding drum and of the last symbol on the following drum, to the reading made up of the symbol "n+1" on the preceding drum and of the first symbol on the following drum. In particular, in the case of a meter composed of a pair of drums numbered from 0 to 9, when the reading is higher than 09, the reading 00 or 19 can be displayed for a certain length of time before the subsequent correct reading 10. It is evident that such inaccuracy can give rise to considerable drawbacks, especially when the readings relate to charges, as in the case of domestic users (gas, water, etc.)

The aim of the present invention is, therefore, to simplify the construction of a transducer device of the type mentioned and thereby lower its production costs.

A further aim is to allow remote reading of the transducer without the use of sliding contacts.

A third aim is to prevent the occurrence of reading errors at the passage from one decade to the other.

The above aim has been achieved by keying the metric drums and the coded revolving elements, which make up the revolving metric indicators, to the same shaft.

In conformance with the invention the number of axes has been brought from three to two, a reduction with respect to the devices of the known type. The reduction of the number of the axes reduces friction in the system; this is very advantageous as metric meters are being dealt with where passive absorption of power by the measuring member is very important, as in the case of electric meter, for example.

The coded revolving elements are, in addition, each positioned ahead out of phase at an appropriate angle with respect to the preceding coded revolving element, or positioned further to the right; in addition the device for the electronic processing of the signal read on the coded revolving elements, does not allow a signal, having a value lower than that of any signal previously sent, to be issued to the displaying device. In this way, errors which can occur at the passage from one decade to the other are eliminated.

The coded revolving elements are read by means of photo-optical type devices, or by magnetic or electromagnetic type proximity sensors; however there is no contact between the reading device and the coded revolving element.

The invention will now be explained with reference to the enclosed drawings, in which:

FIG. 1 shows a front view of the unit, that is a view from 1—1 in FIG. 2;

FIG. 2 shows a section taken along the line 2—2 in FIG. 1;

FIG. 3 shows the processing of the signals in diagram form;

FIGS. 6a, 6b, 7a, 7b, 8, 9, 10, 11 show different possible reading devices.

Figure 4:
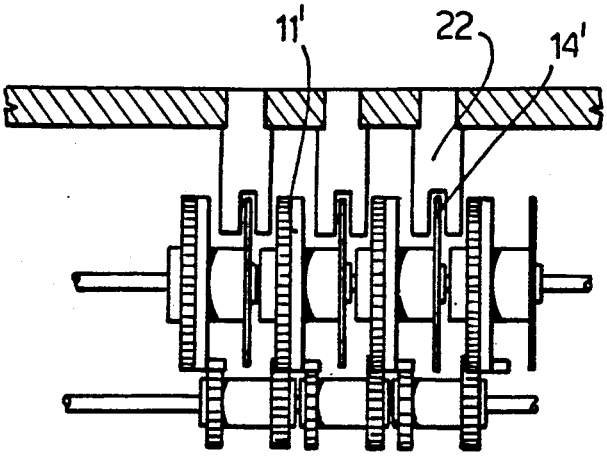
FIGS. 4 and 5 show alternatives to FIG. 1.

In FIGS. 1 and 2 a meter device 1 is seen, comprising a series of coded revolving metric indicators 2, each composed of a metric drum 11, that is a numbered drum, and a decade wheel 14, that is a wheel with slots 15 positioned according to a predetermined binary code; connected to each other by means of a small internal clutch 13, which can be a simple H7 coupling on the shaft 9.

In the connection between each metric drum 11 and each decade wheel 14, the latter is positioned out of phase ahead at an appropriate angle with respect to the preceding decade wheel, the angle having a certain appropriately determined value. The following procedure is adopted for determing the phase displacement angle: taking into account that a displacement of the drum 11 equal to a number corresponds to an angular displacement of 360/10=36 degrees, this number is divided by the number of the decade wheels making up the meter increased by one unit. For example, in the case of 4 decade wheels shown, the number is divided by 4+1=5. The resulting angle is, therefore, equal to 36/5=7.2 degrees.

During assembly, the first decade wheel 14, or the one positioned furthest to the right of the meter, is connected to the respective drum 11 shifted 0° out of phase; the second decade wheel 14 from the right is connected to the respective drum 11 shifted 7.2° out of phase; the third decade wheel 14 from the right is connected to the respective drum 11 shifted 14.4° out of phase, or 7.2° with respect to the preceding decade wheel, and so on.

The metric drums 11 are coupled by means of gears 21 in such a way that to every revolution of the first drum 11, or the one furthest to the right of the meter, corresponds a part revolution of the adjacent drum 11 positioned immediately to the left of the preceding one, and so on. The first drum 11 (on the right in FIG. 1) engages with a drive pinion 12 which is in turn connected to a gear assembly (not visible in the drawing), which can be set in rotation by the passage of a fluid or gas in a duct. The number of revolutions of the meter, which can be read directly on the drums 11 thanks to their numeration, is therefore correlated with the flow of fluid or gas which has passed into the duct.

A reader 22 is positioned corresponding to an area of the periphery of each decade wheel 14. A further reader 23 relates to an element 24 acting as a vernier and integral with the first drum 11.

Thanks to the displacement between the metric drums and decade wheels described above, the possibility of over-readings is eliminated at the moment of passing from one decade to the next (of the type '19' instead of '10', in the example mentioned above). However the possibility of under-readings has not yet been eliminated (of the type '00', in the same example). In order to eliminate this type of error also, intervention is made on the electronic measuring circuit, as will now be described.

Each reader 22 of the decade wheels 14 sends a reading signal to a processing device 18, in accordance with the diagram in FIG. 3. The reader 23 also sends a reading signal to the processing device 18; the signals from readers 22 and 23 are processed so as to increase the accuracy of the measurement. The most accurate measurement can then be sent to a further displaying device 20. The processing device 18 also foresees synchronization of the signals coming from the various readers, in such a way that the signal coming from one reader does not vary until after a subsequent reader has recorded a variation. The handling device 18 also carries out a 'no return' routine, which does not allow the sending of a signal corresponding to a count of an amount lower than that of a count previously made. In this way the possibility of making under-readings is also eliminated.

In FIG. 4 device is shown similar to the one previously described, in which, however, the drums 11, although still coupled so that a complete revolution of one corresponds to a part revolution of the following one, are not numbered and therefore reading is carried out exclusively by means of the readers 22 of the decade wheels 14', which are integral with said drums 11'.

Figure 5:
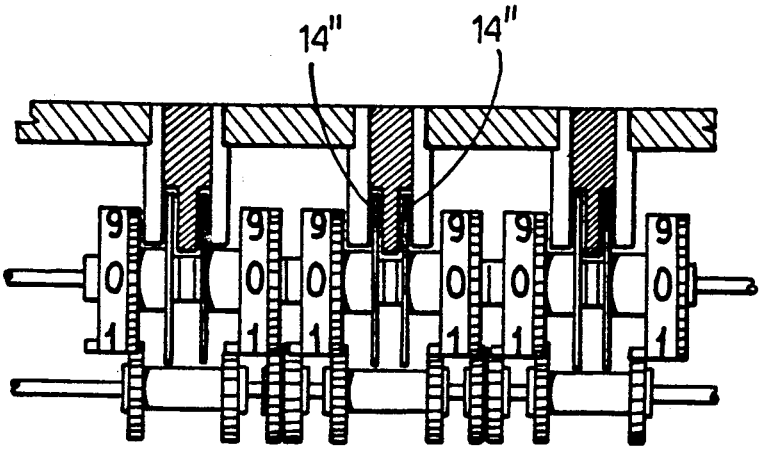

In FIG. 5 device is shown in which the decade wheels 14" are positioned two by two opposite each other.

Figure 6A:
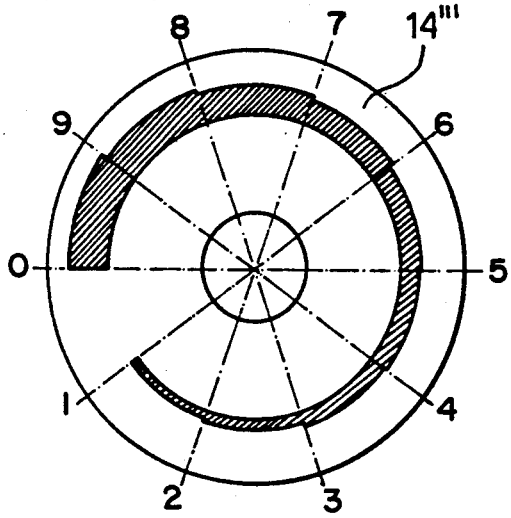
Figure 6B:
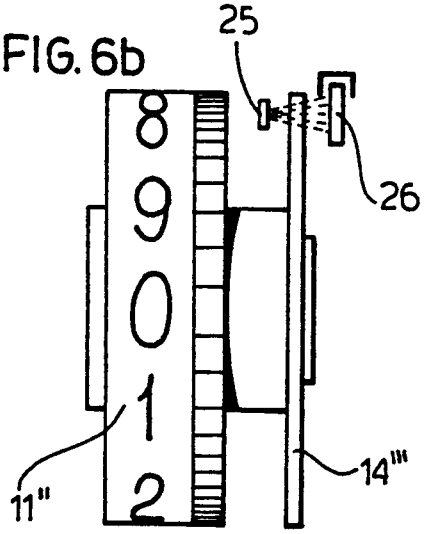

In FIGS. 6a and 6b the diagram is shown of a possible reading device in a transducer device similar to the one in the example illustrated in FIGS. 1 and 2. The decade wheels 14" are wheels which are transparent to light, provided with an opaque strip of stepped width along the circumference. Each value of the width of the strip corresponds to a number. The reading device is composed of a light source 25 and a light meter 26. The light source 25 is focalized onto the measuring strip and conveyed onto the light meter 26; in the light meter element a different tension or current, directly proportional to the width of the opaque strip, and therefore to a different number, corresponds to the different width of the strip.

Figure 7A:
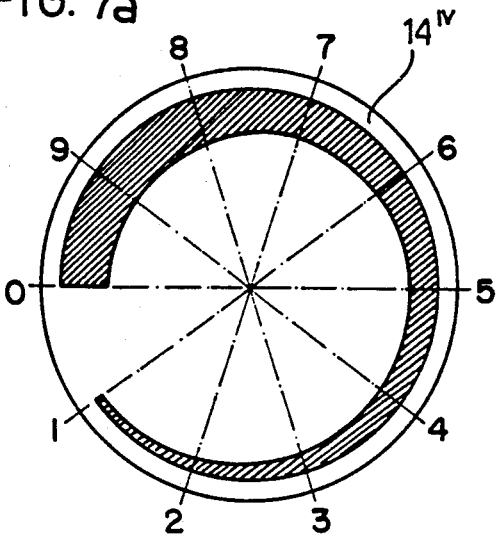
Figure 7B:
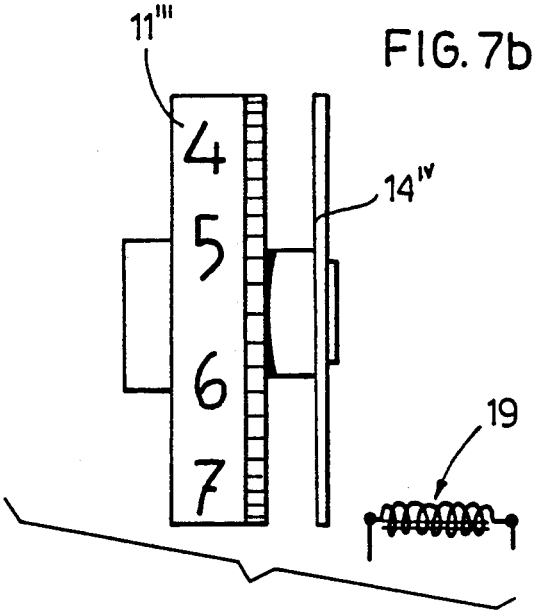

In FIGS. 7a and 7b an electromagnetic resonance reading device is shown. The decade wheels $14^{IV}$ have a magnetic strip which may be coded or not, but is appropriately shaped, either with its width varying continuously or stepped, or shaped in thickness or section. Oscillator coils 19 are positioned opposite said strips, which can be cut directly on the metric drums $11^{III}$. Each magnetic strip, being coupled electromagnetically to the respective resonant circuit 19, determines beats or oscillations on harmonics of the base frequency, which, when appropriately filtered, allow the angular position of the wheel $14^{IV}$ or of the drum $11^{III}$ to be taken.

Figure 8:
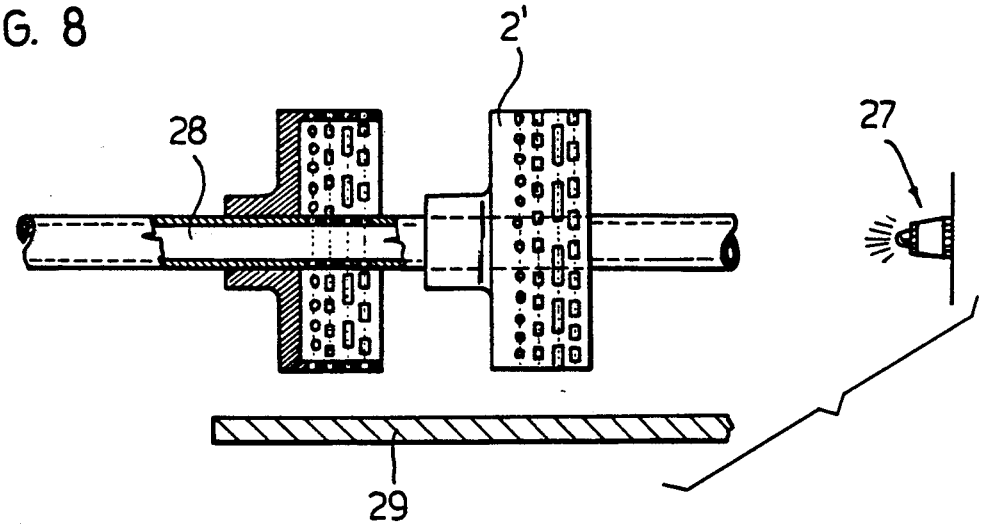

In FIG. 8 a reading device is shown comprising a look-through optical reader 29 and a light source 27 lighting up from inside the shaft 28 onto which are keyed the coded revolving metric indicators 2', slotted on their cylindrical surface.

Figure 9:
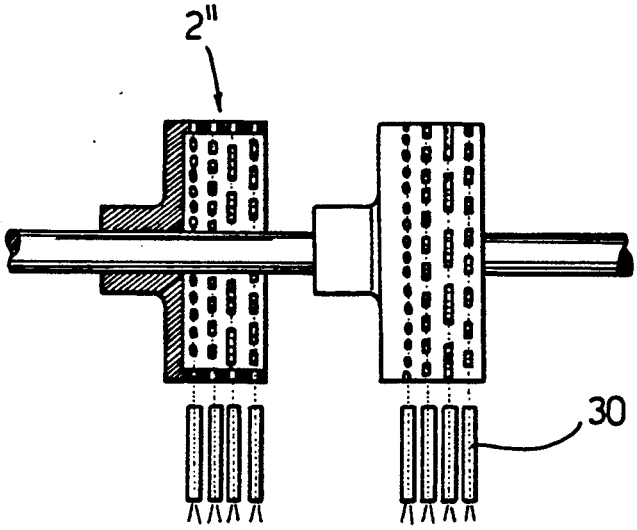

In FIG. 9 a reading device is shown composed of proximity sensors 30, which are also magnetic, relating to the metallic, slotted, coded revolving metric indicators 2".

In FIG. 10 a reading device is shown composed of light meters 31 which measure the light transmitted by the look-through coded decade wheels $14^{V}$, the light, coming from a source and falling on the decade wheels $14^{V}$, and the light transmitted by the latter being deviated by means of a set of offset prisms 32.

In FIG. 11 a reading device is shown composed of an illuminating led 33 and a unit capable of measuring the light reflected by the coded revolving metric indicators 2''', comprising a reflector 35, a lens 34 and an image sensor 36.

Clearly it will be possible to use other reading systems which are suitable for the purpose.

I claim:

1. A transducer device comprising at least one pair of coded revolving metric indicators each comprising a metric drum and a revolving coded element, wherein said metric drums and said revolving coded elements are mounted for rotation on a common shaft, and wherein said coded revolving elements are each positioned out of phase ahead at a predetermined angle with respect to a preceding coded revolving element, said device further comprising a remote display device, a reading device generating signals indicative of rotary position of a said metric drum, and electronic processing means for preventing a signal from being sent to said display device when said signal has a value representing an amount lower than that of any signal previously sent.

2. The device according to claim 1, wherein said predetermined angle is equal to 36 divided by (n+1), where n is the number of the coded revolving elements.

3. The device according to claim 1, wherein each coded revolving element is composed of a decade wheel and wherein the decade wheel and metric drum constituting each revolving metric indicator are separate elements connected to one another mechanically.

4. The device according to claim 3, wherein the connection between each decade wheel and respective metric drum comprises an interval clutch.

5. The device according to claim 1, further comprising a vernier element integral with one of said metric drums.

6. The device according to claim 1, wherein the coded revolving element and the metric drum of each coded revolving metric indicator are formed integrally.

7. The device according to claim 1, wherein the coded revolving elements have slots positioned according to a predetermined binary code.

8. The device according to claim 1, wherein the coded revolving elements have gray coded strips.

9. The device according to claim 7, wherein the coded revolving elements are read by a photo-optical reading device.

10. The device according to claim 7, wherein the coded revolving elements are read by magnetic proximity sensors.

11. The device according to claim 1, wherein the coded revolving elements are transparent and an opaque optical code is secured thereto, said device further comprising a photo-optical reading device.

12. The device according to claim 1, wherein a magnetic strip is placed onto the coded revolving elements, said device further comprising a tuned electromagnetic circuit acting as said reading device.

13. The device according to claim 12, wherein said magnetic strip is coded.

14. The device according to claim 12, wherein said magnetic strip is of variable width.

15. The device according to claim 12, wherein said magnetic strip is of variable thickness.

16. The device according to claim 8, wherein the coded revolving elements are read by a photo-optical reading device.

17. The device according to claim 8, wherein the coded revolving elements are read by magnetic proximity sensors.

* * * * *